United States Patent [19]

Volland et al.

[11] Patent Number: 5,005,609

[45] Date of Patent: Apr. 9, 1991

[54] PNEUMATIC REMOVAL OF DEFECTIVE WEFT FILAMENT

[75] Inventors: Michel Volland; Gilles Grandvallet, both of Bourgoin Jallieu; Roger Fourneaux, La Tour du Pin, all of France

[73] Assignee: S.A. Saurer Diederichs, Bourgoin Jallieu, France

[21] Appl. No.: 357,560

[22] Filed: May 25, 1989

[30] Foreign Application Priority Data

May 25, 1988 [FR] France ..... 88 07257

[51] Int. Cl.[5] ..... D03D 47/30; D03D 51/00

[52] U.S. Cl. ..... 139/116.2; 139/435.5

[58] Field of Search ..... 139/116 A, 116.2, 435.5

[56] References Cited

U.S. PATENT DOCUMENTS

| | | | |
|---|---|---|---|
| Re. 32,916 | 5/1989 | Vermeulen | 139/435.5 |
| 4,502,512 | 3/1985 | Suzuki et al. | 139/116.2 |
| 4,596,276 | 6/1986 | Koriyama et al. | 139/435.5 |
| 4,729,411 | 3/1988 | Ellenberger et al. . | |

FOREIGN PATENT DOCUMENTS

| | | | |
|---|---|---|---|
| 0309013 | 3/1989 | European Pat. Off. | 139/116 A |
| 1052850 | 2/1989 | Japan | 139/116 A |

*Primary Examiner*—Andrew M. Falik

*Attorney, Agent, or Firm*—Herbert Dubno; Andrew M. Wilford

[57] ABSTRACT

A weft filament is inserted as a pick in a weft direction into a shed formed between groups of warp filaments extending and generally traveling in a warp direction, and is beaten into the warp filaments by a comb to form a woven textile. A defective pick is removed from the warp filaments by a system comprising at least one stripping nozzle directed generally upstream in the warp direction and connected to a supply that feeds compressed gas to the nozzle so the gas is expelled therefrom as a jet directed generally upstream in the warp direction over the defective pick to dislodge same from the warp filaments. The defective pick is then withdrawn in the weft direction from the shed after it is dislodged from the warp filaments by the nozzle.

18 Claims, 3 Drawing Sheets

PNEUMATIC REMOVAL OF DEFECTIVE WEFT FILAMENT

FIELD OF THE INVENTION

The present invention relates to the removal of a defective weft filament from a textile as same is being woven. More particularly this invention concerns such a system used in a shuttleless loom where the weft is injected pneumatically into the warp.

BACKGROUND OF THE INVENTION

In a standard shuttleless loom a weft yarn is pulled from a supply spool by a mechanical feeder and fed through a fixed-resistance mechanical brake to a nozzle that is directed crosswise through a shed formed between upper and lower groups of warp yarns. Inside the shed the yarn is guided along a passage formed by the teeth of a confining comb mounted on a support along with the beating comb. The yarn is moved the entire weftwise width of the fabric by relay nozzles spaced along the shed and pressurized sequentially. At the downstream edge of the goods the yarn is trapped by a weft-yarn aspirator and held thereby.

Occasionally the weft yarn, called the pick when inserted into the shed, breaks and this breakage is detected by a photocell arrangement. French patents 2,537,168 and 2,583,435 describe mechanical arrangements for extracting the pick, a job that is particularly difficult after it has been beaten into the warp by the comb. First the defective pick must be stripped off the preceding pick, typically by a system of needles, and then it must be pulled weftwise out of the fabric, for instance by a pincher-type gripper. Such arrangements do not allow a pick that has been broken into several pieces to be extracted fully, and are normally unable to actually unweave a portion of the fabric, that is strip out several successive bad picks.

In European patent application 100,939 (see U.S. Pat. No. 4,502,512) a combined pneumatic/mechanical system is employed to separate out a bad pick and pull it out of the goods. The mechanical elements can damage the goods and, like the preceding arrangements, the device has a problem when the actual location where the pick is beaten moves somewhat, as is common in weaving.

OBJECTS OF THE INVENTION

It is therefore an object of the present invention to provide an improved system for removing a defective pick from a piece of goods as it is being woven.

Another object is the provision of such an improved system for removing a defective pick from a piece of goods as it is being woven which overcomes the above-given disadvantages, that is which accurately strips out a pick even when it is in several pieces, and that never damages the preceding weft filaments and the warp.

Another object is to provide an improved method of and apparatus for removing a pick that can actually be used to unweave the goods, that is which can accurately strip out several picks even after they have been beaten in.

SUMMARY OF THE INVENTION

Thus according to the invention a weft filament is inserted as a pick in a weft direction into a shed formed between groups of warp filaments extending and generally traveling in a warp direction, and is beaten into the warp filaments by a reed or comb to form a woven textile. A defective pick is removed from the warp filaments by a system comprising at least one stripping nozzle directed generally upstream in the warp direction and connected to a supply that feeds compressed gas to the nozzle so the gas is expelled therefrom as a jet directed generally upstream in the warp direction over the defective pick to dislodge same from the warp filaments. The defective pick is then withdrawn in the weft direction from the shed after it is dislodged from the warp filaments by the nozzle.

Thus with this system a blast of compressed air is used to push a defective pick back out of the warp filaments. Thus no mechanical elements engage the textile being formed and damage is virtually impossible. In addition the jet will be effective to dislodge the defective pick even if the exact region where the two warp groups joins moves a little, so long as the jet plays over it.

According to this invention the nozzle moves along the weft on a guide constituted by a guide rail extending in the weft direction. The nozzle is normally to one vertical side of all of the warp filaments, either above or below. The guide itself includes a guide rail extending in the weft direction to the one vertical side of the warp filaments and a link connected to the nozzle and engaging the guide rail. It can also include a roller attached to the nozzle and riding on the textile downstream in the warp direction from the shed.

In accordance with another system of this invention there is a plurality of such nozzles arrayed in a weftwise row along the shed and the control means sequentially pressurizes the nozzles.

The beating-in comb of the loom can forms a pick-guiding channel extending in the weft direction along the shed and the loom can be provided with an insertion nozzle that blows the picks through the shed and with relay nozzles spaced along the jet for advancing the inserted picks along the shed. In this arrangement the withdrawing unit includes a pneumatically operated system for aspirating the defective pick along the channel. This unit is a trap open toward the nozzle in line with the jet thereof and constructed to catch and hold the defective pick dislodged by the jet, and a link interconnecting the trap and the nozzle for synchronously moving same weftwise across the shed. The trap is a tube having a pair of open ends one of which is clear and opens directly toward the nozzle and the other of which is foraminous so that only gas can pass through it. A support on the trap rides on and is guided in the channel. Furthermore in this arrangement the withdrawing unit further includes a blowing nozzle alignable with the foraminous end of the trap outside the shed for blowing air into the foraminous end and clearing the trap. This nozzle can simply be the same nozzle that is used to dislodge the bad pick.

The withdrawing unit of this invention can also be an aspirating head displaceable in the weft direction through the shed synchronously with the nozzle. A vacuum source is connected to this head by a vacuum tube extending and telescoping in the weft direction.

DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
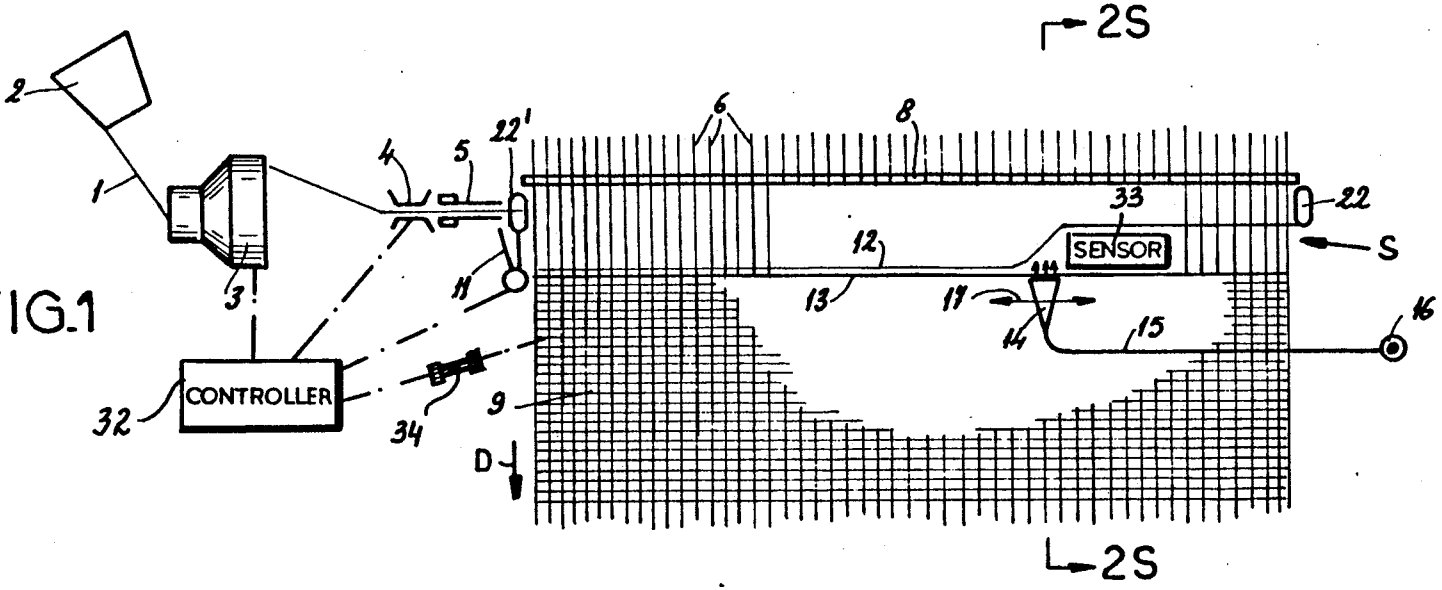
FIG. 1 is a largely schematic top view of a loom operating according to this invention.
Figure 2:
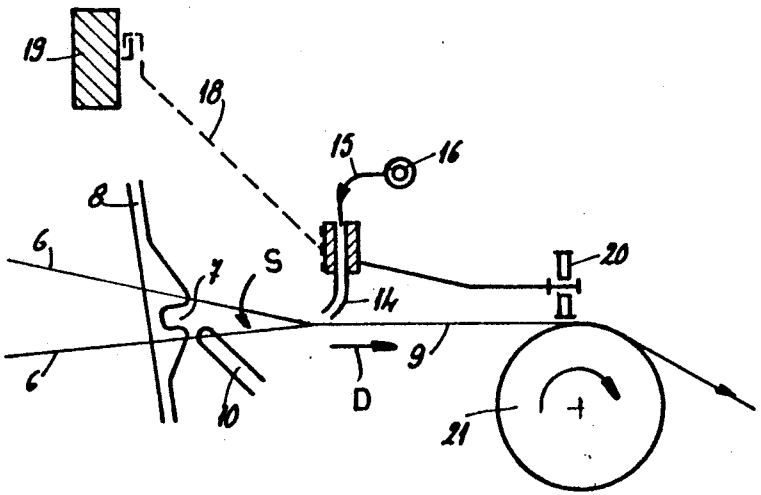
FIG. 2 is a section taken along line 2S—2S of FIG. 1.
Figure 3:
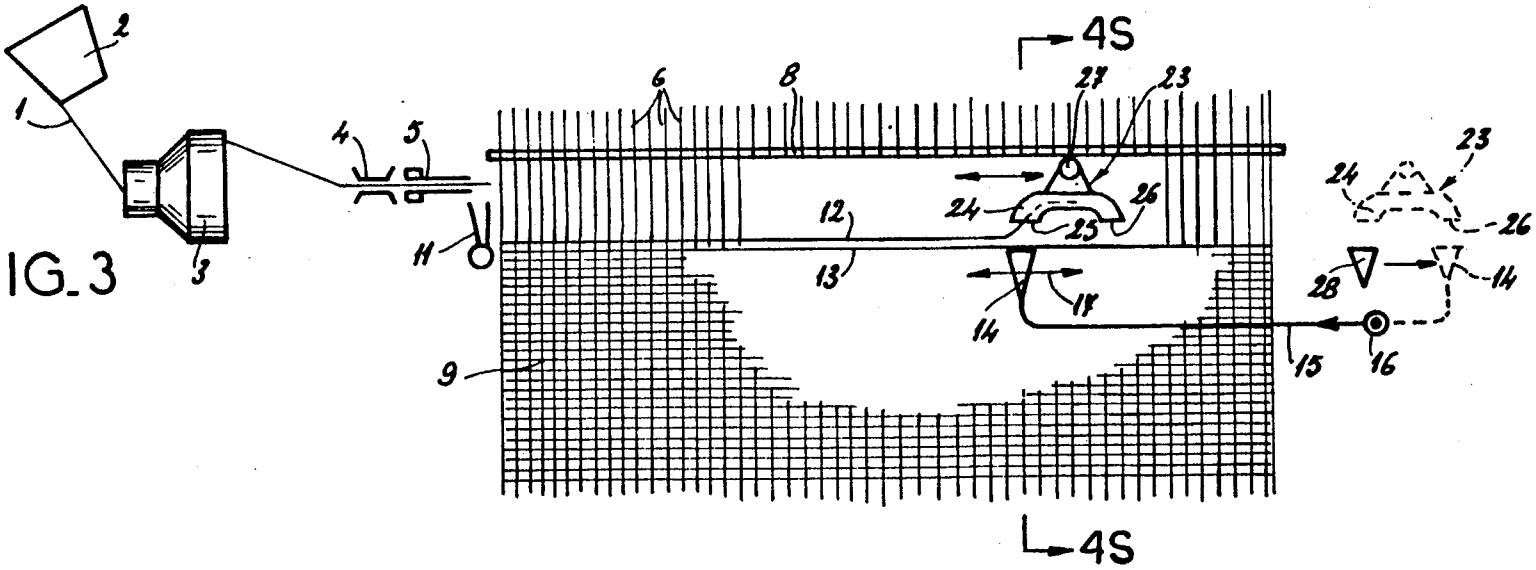
FIG. 3 is a view like FIG. 1 of another loom in accordance with the invention.
Figure 6:
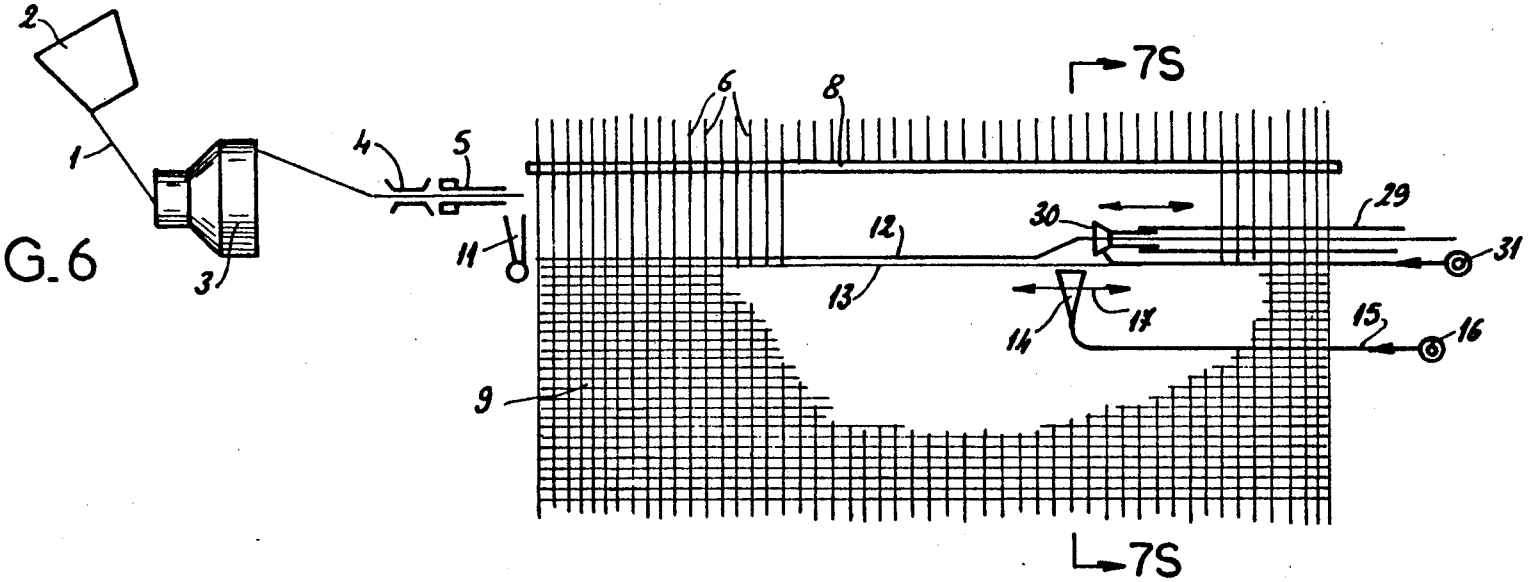
FIG. 6 is another view like FIGS. 1 and 3 of yet another loom according to the invention.

As seen in FIGS. 1, 3, and 6, a weft filament or yarn 1 is pulled from a supply spool 2 and furnished by a mechanical feed 3 to a mechanical brake 4 and then to a standard pneumatic weft-injecting nozzle 5, all operated by a controller 32 comprising various drives connected to the various elements to effect the movements and operations described below. Upper and lower groups of warp yarns 7 form a shed S having an insertion channel 7 formed by notches in the teeth of a standard beating-in comb 8 to form, with successive picks 12 and 13 of the yarn 1, a fabric 9 that moves in a warp direction D (FIG. 2) over a takeup spool 21. Relay nozzles 10 are provided which are directed downstream in a weft direction 17 (right to left in FIGS. 1, 3, and 6) and which are sequentially supplied with compressed air to move the picks 12 and 13 weftwise through the shed along the channel 7. On the outboard side of the goods 9 there is a standard weft-yarn aspirator 22 and holder as described in my copending patent application (07/349,626 filed 10 May 1989 U.S. Pat. No. 4,936,353), to which reference should be made for further details.

According to this invention as shown in FIGS. 1 and 2 the pick 12 is examined after insertion by an automatic optoelectric sensing unit shown schematically at 33 and connected to the controller 32. This takes place after the pick 12 and/or 13 is beaten into the fabric 9 by the comb 8. Such a bad pick 12 is separated from the rest of the goods 9 by a nozzle 14 connected via a pressure line 15 to a source 16 of pressurized air and displaceable by the controller 32 in the warp direction 17 perpendicular to the warp direction D of the goods 9. The nozzle 14 is directed upstream, that is against the direction D, so that it will dislodge the bad filament 12 from the warp yarns 6, provided of course that the shed S has been appropriately opened by the controller 32.

FIG. 2 shows how the nozzle 14 is supported by an arm 18 on a guide 19 that extends above the goods in the weft direction, and by a roller 20 that rides along the takeup roll 21. The controller 32 is connected to a double-acting actuator illustrated schematically at 34 that can move the nozzle 14 the full width of the goods 9.

Thus the bad pick 12, which is typically in two or more pieces, is blown by the nozzle 14 which is directed at just where the two halves of the warp join, back into the channel 7. Then the relay nozzles 10 blow the pieces along this channel 7 to the aspirator 22 which removes them. A second such aspirator 22' can be provided at the insertion end of the shed to remove any piece between this end and the first of the relay nozzles.

In fact it is possible according to this invention by appropriate reverse manipulation of the unillustrated heddles controlling the warp yarns 6 to remove successive picks 12 and 13. This in effect can constitute an unweaving of the goods when, for instance, the sensor 33 can only detect a weft flaw downstream in the direction D of the weft-insertion region.

Figure 4:
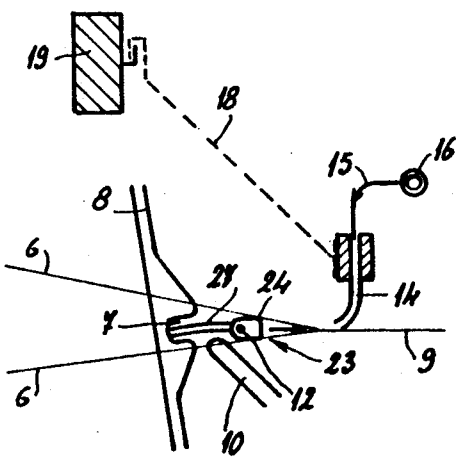
FIG. 4 is a section taken along line 4S—4S of FIG. 3.

The system of FIGS. 3 and 4 is similar to that of FIGS. 1 and 2 except that the pick 12 being removed is not blown into the channel 7 and then conveyed by the nozzles 10 to the aspirator 22. Instead this pick 12 is caught by a mechanical trap 23 constituted as a U-shaped tube 24 having two ends 25 and 26 both open downstream in the direction D. This trap 23 travels via a roller guide 27 in the channel 7 to move in the weft direction 17 across the goods 9 and is coupled to the nozzle 14 to move with it with the one end 24 open downstream directly in line with this nozzle 14.

According to this invention the other end 26 of the trap is provided with a screen or is otherwise foraminous. Thus as a bad pick 12 or 13 is blown out of the goods 9 it will be blown into the mouth 25 of the trap 23, which itself somewhat spreads the shed to facilitate removal of the bad pick. The screened end 26 will prevent it from being blown out of the trap 23 and the pieces of the pick 12 (and 13 if desired) will remain there.

After the bad pick 12 is thus removed the trap 23 is moved to the position shown in dashed lines with the intake mouth 24 aligned with a suction device 28 that strips the weft pieces out of it. It is also possible as shown in dashed lines for the blowing nozzle 14 to be moved into alignment with the screened mouth 26 to assist clearing of the trap 23.

Figure 5:
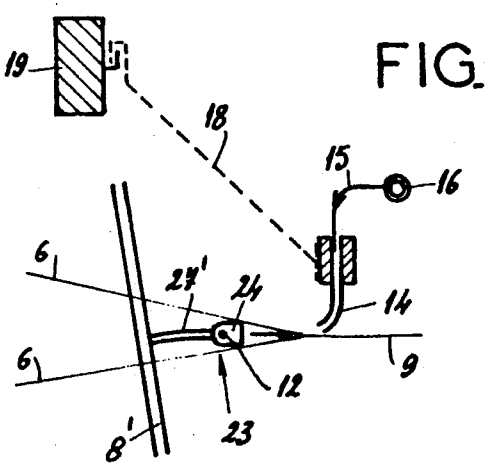
FIG. 5 is a view like FIG. 4 but showing a variation on the system of FIG. 3.

The system of FIG. 5 varies from that of FIGS. 3 and 4 in that the comb 8' does not form a channel 7 so that the guide 27' of the trap 23 rides directly on these flat teeth of the comb 8', such an arrangement can also be used with a system which inserts the weft via a standard shuttle, that is not pneumatically.

Figure 7:
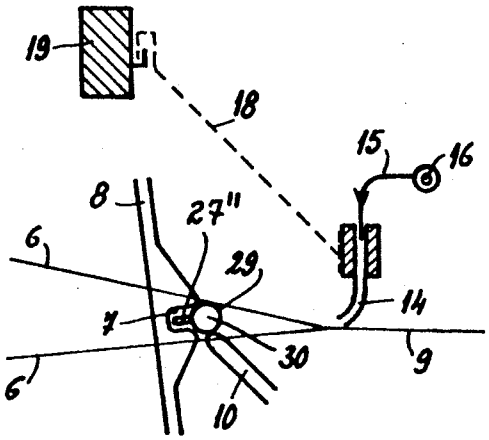
FIG. 7 is a section taken along line 7S—7S of FIG. 6.

In FIGS. 6 and 7, where the nozzle 14 is identical to that of FIGS. 1 through 5, the bad pick is aspirated through a tube 29 that telescopes in the direction 17 and that has an end 30 that opens in the direction 17 toward the insertion nozzle 17 and that is coupled to move across in the shed, supported by a guide 27" in the channel 7, synchronously with the nozzle 14. This tube 29 is connected to a pressurized-air source that works venturi-fashion to create a low-pressure zone at the end 30 so that a bad pick 12 dislodged from the goods 9 will be aspirated into the end 30. Such a system also works with the relay nozzles 10 to ensure that even small fragments of a bad pick 12 or 13 will be stripped from the goods 9.

Figure 8:
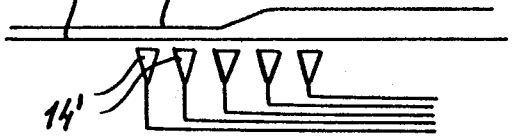
FIG. 8 is a small-scale view of another variant on the system of this invention.

It is possible in any of the above-described systems as illustrated partially in FIG. 8 to replace the traveling nozzle 14 with a plurality of nozzles 14' that are sequentially pressurized like the nozzles 10 to move the jet of air created thereby across the goods 9.

According to this invention the nozzle 14 and/or the trap 23 and/or the aspirating end 30 can be carried on cables, belts, or the like operated by pulleys to move them back and forth across the goods in the direction 17. A magnetic coupling or synchronous motors could be used also.

When a mechanical holder is used at the outboard side of the goods its opening is synchronized with operation of the dislodging nozzle 14. This can be done by triggering its opening by an element mounted on the nozzle 14 or other elements linked thereto.

We claim:

1. In a loom wherein a weft filament is inserted as a pick in a weft direction into a shed formed between groups of warp filaments extending and generally traveling in a warp direction, and is beaten into the warp filaments by a comb to form a woven textile, a system for removing a defective pick from the warp filaments, the system comprising:

at least one stripping nozzle directed generally upstream in the warp direction;

supply means for feeding a compressed gas to the nozzle so the gas is expelled therefrom as a jet directed generally upstream in the warp direction over the defective pick to dislodge same from the warp filaments;

guide means for displacing the nozzle in the weft direction as it directs the jet of compressed gas at the defective pick; and means for withdrawing the defective pick from the shed after being dislodged from the warp filaments by the nozzle.

2. The loom system defined in claim 1 wherein the nozzle is positioned vertically to one side of all of the warp filaments.

3. The loom system defined in claim 2 wherein the nozzle is above the warp filaments.

4. The loom system defined in claim 2 wherein the guide means includes a guide rail extending in the weft direction to the one vertical side of the warp filaments and a link connected to the nozzle and engaging the guide rail.

5. The loom system defined in claim 4 wherein the guide means includes a roller attached to the nozzle and riding on the textile downstream in the warp direction from the shed.

6. The loom system defined in claim 1 wherein there are a plurality of such nozzles arrayed in a weftwise row along the shed, the system further comprising control means for sequentially pressurizing the nozzles.

7. The loom system defined in claim 1 wherein the comb of the loom forms a pick-guiding channel extending in the weft direction along the shed and the loom is provided with an insertion nozzle that blows picks through the shed and with relay nozzles spaced along the jet for advancing the inserted picks along the shed, the withdrawing means including a pneumatically operated system for aspirating the defective pick along the channel.

8. The loom system defined in claim 7 wherein the withdrawing means includes a trap open toward the stripping nozzle in line with the jet thereof and including means to catch and hold the defective pick dislodged by the jet, and means interconnecting the trap and the stripping nozzle for synchronously moving the trap weftwise across the shed.

9. The loom system defined in claim 8 wherein the trap is a tube having a pair of open ends one of which is clear and opens directly toward the stripping nozzle and the other of which is foraminous so that only gas can pass through it.

10. The loom system defined in claim 9 wherein the trap includes a support riding and guided in the channel.

11. The loom system defined in claim 9 wherein the withdrawing means further includes means alignable with the foraminous end of the trap outside the shed for blowing air into the foraminous end and clearing the trap.

12. The loom system defined in claim 9, further comprising means for moving the trap into an end position outside the shed and for moving the stripping nozzle into a position aligned with the foraminous end of the trap in the end position thereof to blow the defective pick out of the trap.

13. The loom system defined in claim 1 wherein the withdrawing means includes an aspirating head, and means for moving the aspirating head in the weft direction through the shed synchronously with the nozzle.

14. The loom system defined in claim 13 wherein the withdrawing means further includes a vacuum source, and a vacuum tube extending and telescoping in the weft direction between the vacuum source and the aspirating head.

15. In a loom wherein a weft filament is inserted as a pick in a weft direction into a shed formed between groups of warp filaments extending and generally traveling in a warp direction, and is beaten into the warp filaments by a comb to form a woven textile, a system for removing a defective pick from the warp filaments, the system comprising:

at least one stripping nozzle directed generally upstream in the warp direction;

supply means for feeding a compressed gas to the nozzle so the gas is expelled therefrom as a jet directed generally upstream in the warp direction at the shed;

control means for displacing the nozzle in the weft direction along the shed to play the jet over the defective pick to dislodge same from the warp filaments; and means for aspirating the defective pick from the shed after the defective pick is dislodged by the gas get from the warp filament.

16. In a weaving process wherein a weft filament is inserted pneumatically as a pick in a weft direction into a shed formed between groups of warp filaments extending and generally traveling in a warp direction, and is beaten into the warp filaments by a comb to form a woven textile, a method of removing a defective pick from the warp filaments, the method comprising the steps of:

supplying a compressed gas to a stripping nozzle directed generally upstream in the warp direction at the shed;

displacing the nozzle in the weft direction along the shed to play the jet over the defective pick to dislodge it from the warp filaments; and pneumatically removing the defective pick from the shed after the defective pick is dislodged by the gas jet from the warp filaments.

17. The process defined in claim 16 wherein the defective pick is removed from the shed by being aspirated therefrom.

18. The process defined in claim 16 wherein the defective pick is removed from the web by being blown into a trap moved along in the shed synchronously with the nozzle.

* * * * *